US010548355B2

(12) United States Patent
Volpis et al.

(10) Patent No.: US 10,548,355 B2
(45) Date of Patent: Feb. 4, 2020

(54) ATHLETIC WARMER APPAREL

(71) Applicants: Paolo Volpis, Beverly Hills, CA (US); Yuyu Myinttun, Los Angeles, CA (US)

(72) Inventors: Paolo Volpis, Beverly Hills, CA (US); Yuyu Myinttun, Los Angeles, CA (US)

( * ) Notice: Subject to any disclaimer, the term of this patent is extended or adjusted under 35 U.S.C. 154(b) by 603 days.

(21) Appl. No.: 14/882,030

(22) Filed: Oct. 13, 2015

(65) Prior Publication Data

US 2016/0165969 A1 Jun. 16, 2016

Related U.S. Application Data

(63) Continuation-in-part of application No. 13/781,544, filed on Feb. 28, 2013, now abandoned.

(51) Int. Cl.
*A41D 13/00* (2006.01)

(52) U.S. Cl.
CPC ..... *A41D 13/0017* (2013.01); *A41D 2300/22* (2013.01)

(58) Field of Classification Search
CPC . A41D 13/00; A41D 13/0017; A41D 2300/22
See application file for complete search history.

(56) References Cited

U.S. PATENT DOCUMENTS 1,799,336 A * 4/1931 Walser ..... A41D 1/22 2/71
D106,689 S * 10/1937 Laye ..... D2/806
2,276,609 A * 3/1942 Cadous ..... A41D 1/22 2/74
2,280,479 A * 4/1942 Coben ..... A41D 27/10 2/115
2,613,360 A * 10/1952 Friedland ..... A41D 13/0015 2/113
3,085,256 A * 4/1963 Smith ..... A41D 27/24 112/414
3,339,553 A * 9/1967 Ritter ..... A41B 9/10 134/57 R

* cited by examiner

*Primary Examiner* — Anna K Kinsaul

(57) ABSTRACT

An apparel comprises a body portion and a pair of arm portions, where an underarm region is located between said body portion and each said arm portions. The body portion further comprises (a) a torso portion, (b) a skirt portion, (c) a band portion located between the torso and skirt portion and (d) at least one elastic element located between the band portion and underarm region. Alternatively, (d) the at least one elastic element may extend from the skirt portion to the underarm region. The band portion may be located in the interior space of the apparel.

20 Claims, 20 Drawing Sheets

| FABRIC & TRIM PLACEMENT - BACK | | | |
|---|---|---|---|
| SEASON: | ALL SEASON | DATE: | 9/1/201X |
| GROUP NAME: | WARMER | STYLE #: | EDGE |
| SIZE CLASSIFICATION / RANGE: | Women S-XL | TECHNICAL DESIGNER: | PV |
| FABRIC NAME: | FABRIC NAME: | PRODUCT CATEGORY: | THERMOBRIX™ |
| FIBER CONTENT: | 80% Poly, 20% Spand. | BRAND / LABEL: | YUYU DESIGN |
| STYLE DESCRIPTION: | n/a | | |

ATHLETIC WARMER APPAREL

COPYRIGHT

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

TECHNICAL FIELD

This disclosure generally relates to apparel, and specifically to high performance sports apparel.

DESCRIPTION

A number of sports are primarily played outdoors. Examples include, but are not limited to tennis, golf, volleyball, basketball, soccer, softball, lacrosse, as well as amateur sports such as gymnastics, running, yoga, biking and swimming. Before participating in such sporting activities, be it actual competition or just practice, an athlete needs to warm up. In such cases, the athletic apparel should keep the athlete warm and remain practical for the sport, for example accommodating independent upper and lower body movement.

Tennis is a prime example, where players need practical warmer apparel before playing outdoors. For instance, the current tennis outfits for female players consist of a top with a separate skirt, or a one-piece dress which integrates the top with the skirt. The outfit is usually sleeveless or with short sleeves. Typically during warm up, a player wears a warm up sweater or jacket for the upper body, and warm up pants for the legs. The pants are usually worn either over the skirt or under the skirt. However, neither option is comfortable for a female player. If the skirt is worn under the pants, it would be tucked and consequently wrinkled and making the outfit bulky and the player looking awkward. On the other hand, if the skirt is worn over the pants, the overall look is just as awkward, if not more.

Moreover, a major privacy concern arises when the skirt is worn without integrated underpants. For example, at the moment when the pants are removed in a public place, the player may feel very uncomfortable about being somewhat exposed. Even further, since the ball pockets are located in the underpants, reaching for the balls while warming up with pants can become very unpractical because the player would have to raise the skirt to put her hand inside the warm up pants for each ball. Such issues arise, whether the tennis outfit is a separate top and skirt, or if both are integrated into one piece.

A one-piece warmer apparel may also be impractical, for example, if it hinders athletic movement or tends to move out of position, bunch up, or rise from the bottom. For instance, a long one-piece sweater would likely rise up every time the athlete raises one hand to serve or hit an overhand.

In addition to practicality and comfort issues, both options (skirt above warm up pants, or underneath) are not aesthetic. Female tennis players want to wear apparel that provides a feeling of comfort particularly when they see their silhouette on the tennis court. In particular, an outfit that enhances a female player's shape, rather than create a thick bulky look, is very appealing.

To date, such issues with athletic warmer apparel still persist not only for tennis but for various other sports including those already mentioned. Accordingly, there exists a need for an athletic warmer outfit that is practical, functional, comfortable and aesthetic.

SUMMARY

In one embodiment, an apparel comprises a body portion and a pair of arm portions, where the body portion further comprises a torso portion, a skirt portion, a band portion and at least one elastic element.

In another embodiment, an apparel comprises a body portion and a pair of arm portions, where an underarm region is located between said body portion and each said arm portions. The body portion further comprises (a) a torso portion, (b) a skirt portion, (c) a band portion located between the torso and skirt portion and (d) at least one elastic element extending from the band portion to the underarm region.

In another embodiment, an apparel comprises a body portion and a pair of arm portions, where an underarm region is located between said body portion and each said arm portions. The body portion further comprises (a) a torso portion, (b) a skirt portion, (c) a band portion located between the torso and skirt portion and (d) a plurality of elastic elements located between said band portion and underarm region.

In yet another embodiment, an apparel comprises a body portion and a pair of arm portions, where the body portion further comprises a torso portion and a skirt portion. The body portion further comprises a band portion and a plurality of elastic elements arranged such that an individual wearing said apparel can raise one or both arms without causing the skirt portion to substantially move upward.

In still another embodiment, an apparel comprises a body portion, a pair of arm portions and an underarm region located between said body portion and each said arm portions. Specifically, the body portion comprises, a torso portion, a skirt portion, a band portion located between said torso portion and said skirt portion. Further, at least one elastic element extends from the skirt portion to the underarm region. The apparel comprises an interior area and the band portion is located within said interior area of the apparel and underneath said at least one elastic element.

DETAILED DESCRIPTION OF THE EMBODIMENTS

Figure 1:
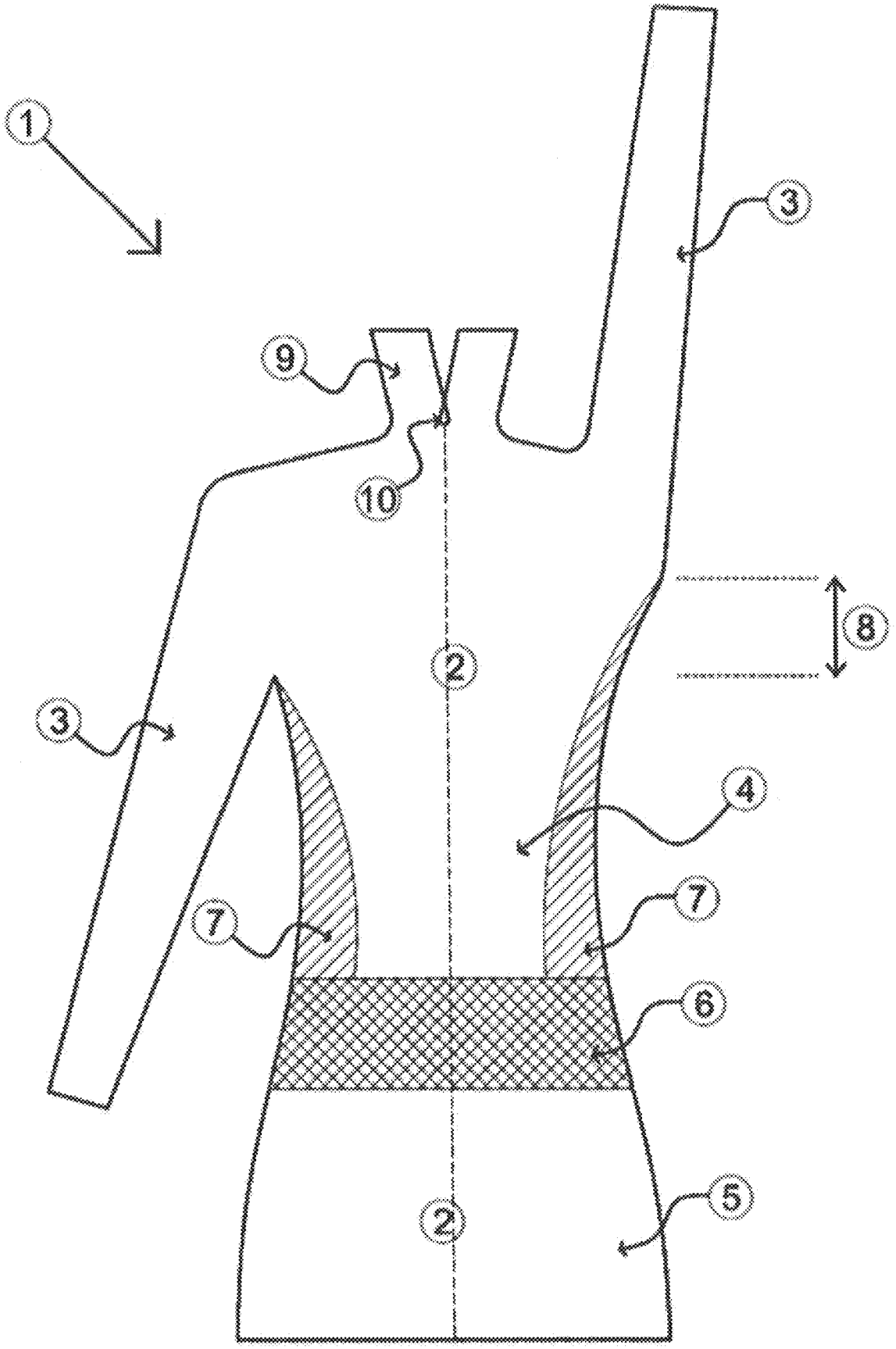
FIG. 1 depicts an apparel according to one embodiment.

The present embodiments describe athletic warmer apparel that address the aforementioned issues. In particular, the embodiments describe apparel that deliver practicality, functionality, and comfort without sacrificing aesthetics.

In one embodiment, the apparel comprises a body portion and a pair of arm portions, where an underarm region is located between said body portion and each said arm portions. The body portion further comprises (a) a torso portion, (b) a skirt portion, (c) a band portion located between the torso and skirt portion and (d) at least one elastic element extending from the band portion to the underarm region.

The apparel is preferably one-piece such that the torso portion and the arm portions are formed from a single piece of fabric. In some embodiments, the body portion is one-piece. The apparel may comprise any fabric commonly employed in sporting apparel, which may be a natural, synthetic or a combination thereof. Moreover, the fabric may be multi-ply for added thermal insulation and/or performance. Certain regions of the fabric may comprise more elastic fibers than others. In one embodiment, the apparel fabric comprises a polyester and spandex blend.

The underarm region of the apparel is generally located at or near the armpit of the individual wearing the apparel, which may slightly differ based on the body shape of the individual and/or construction of the apparel. Thus, in one aspect, the underarm region comprises the torso portion of the apparel. In another aspect, the underarm region comprises the arm portion of the apparel. In yet another aspect, the underarm portion comprises both the torso portion and the arm portion. In a particular embodiment, the underarm region comprises the torso and arm portions, which are in contact with, or directly next to the individuals arm pits.

The length of the apparel can vary. In one aspect, the body portion is sufficiently long to at least partially keep a player's upper legs warm. In another aspect, the body portion is sufficiently long such that it covers the entire tennis outfit worn underneath. For example, a standard tennis skirt reaches half distance between the female player's hip and knee. As such, in a preferred embodiment, the torso portion extends below the midway point between a female player's hip and knee. Most preferably, the torso portion extends beyond the tennis skirt by at least about 1.5 inches. It is contemplated that the apparel may be worn on its own without a tennis outfit underneath, for example, when the player knows that the weather conditions would not allow short sleeve/sleeveless tops or light fabric skirts. In such cases, the apparel may additionally comprise integrated shorts underneath the skirt portion. Accordingly, in some embodiments, the apparel dimensions are independent of clothing worn underneath.

In the present embodiments, the body portion comprises a band portion. The precise location of the band portion may vary depending on the size of the apparel and the body type of the athlete. Thus, in one aspect, the band portion is located at the middle or lower half of the body portion. In another aspect, the band portion is located at about or below an athlete's waist. In yet another aspect, the band portion is located at about or below an athlete's hips.

In one aspect, location of the band portion determines the upper and lower regions of the body portion. That is, the upper region generally extends from about the band portion upwards to the neck portion while the lower region generally extends from about the band portion downward to the legs.

In an embodiment, the lower region of the body portion further comprises a skirt portion. In one embodiment, the skirt portion extends downward from the band portion to the knees. The skirt portion may be slightly flared out, tapered, form fitting, or simply hang lose around the upper legs. In the preferred embodiments, the skirt portion is form fitting but does not inhibit a player's mobility.

In one embodiment, the upper region of the body portion further comprises at least one elastic element. The elastic element(s) are generally located between the band portion and the underarm region. In the preferred embodiments, the elastic element(s) extend from the band portion to the underarm region. In some embodiments, the elastic element(s) may span the entire length of the upper region of the torso portion. As such, the elastic element may be one piece. Alternatively, the elastic elements may comprise a plurality of strips. Preferably, each of the plurality of elastic elements is separate and integrated into the upper region fabric.

In a preferred embodiment, the body portion comprises two elastic elements each located on opposite sides of the torso portion and extending from the band portion to the underarm region. In general, there is no restriction on the shape of the elastic element so long as it provides the necessary function, as a person skilled in the art would readily ascertain from the present disclosure. As such, the shape of the elastic elements can include, but are not necessarily limited to, generally rectangular, triangular or oval shapes. Moreover, the elastic elements need not be one continuous piece. For instance a series of separate elastic elements may be linearly located between the band portion and the under arm region. Thus, a series of linearly connected or spaced elastic elements may be located between the band portion and the under arm region, to achieve the desired functionality.

It is desirable for the torso portion to at least partially elongate (elastically stretch) during common athletic motions to help maintain independent movement between the upper and lower portions of the apparel. To that end, an aspect of the present embodiments concerns the elastic properties of the elastic elements. In one aspect, the elastic element(s) extend or elongate under typical forces associated with typical athletic movements, and elastically recover to their original length after the conclusion of the movement.

In another aspect, the elastic elements exhibit about 100 percent elastic recovery after stretching or elongating.

A non-limiting general example of an athletic movement may involve raising (or stretching) one or both arms (e.g. above the shoulders) and lowering or returning them to the original position. Within the context of tennis, an athletic movement may include, but is not limited to, tossing the ball up, serving the ball, hitting an overhand, or stretching sideways (e.g. substantially parallel to the ground) to reach or hit the ball. Similarly for volleyball, exemplary athletic movements may include hitting overhand serve, setting the ball, spiking the ball or blocking an opponent at the net. As for basketball, non-limiting examples include shooting the ball, going up for a rebound or defending a pass or shot. During golf, exemplary athletic movement may involve teeing off, hitting a chip shot, or any other shot requiring substantial wind up and/or follow through. In the context of an amateur sport such as yoga, non-limiting example of athletic movements may involve getting into "downward dog," "triangle" or "side stretch" poses. While the above is a non-exhaustive list of athletic movements, based on these examples a person skilled in the relevant art can readily determine which athletic movements benefit from apparel with independently moving upper and lower portions.

The specific elastic properties of the elastic element(s) may be described in various ways. In one embodiment, the elastic element(s) can elastically stretch between at least about 5 percent and about 300 percent (including every value within the range) in one or more directions. Preferably, the elastic element(s) stretch between about 5 percent and about 200 percent in one or more directions (including every value within the range). Most preferably, the elastic element(s) stretch between about 20 percent and about 100 percent (including every value within the range).

Generally, the elastic element(s) can comprise any fabric that provides the desired elastic properties. The elastic element(s) may comprise an elastic fabric such as spandex. Alternatively, the fabric may be a blend of different types of material (synthetic or natural) such as, but not limited to, a blend comprising spandex and polyester. In the preferred embodiments, the elastic element comprises between about 10 percent and about 90 percent spandex (including every value in the range). In another embodiment, the elastic element comprises a fabric blend comprising between about 10 percent and about 90 percent spandex (including every value in the range), and the balance polyester. In yet another embodiment, the elastic element comprises a fabric blend comprising between about 10 percent and about 90 percent (including every value in the range) of spandex and polyester, with the balance being a third type of synthetic or natural material.

In some embodiments, it is specifically preferred that the torso portion elongates along the sides (next to the player's ribs) for example, during a server or an overhand hit. This may be achieved with one or more elastic elements integrated into the torso portion. For instance, an elastic element may be located along each side of the torso such that the hand being raised causes the elastic element(s) on that side to lengthen. Alternatively, plurality of elastic elements may be located along the side region, such that in the aggregate, they allow the torso portion to sufficiently elongate, as would a single elastic element to achieve the same result. In some embodiments, the sides of the torso portion can stretch by at least about 2-3 inches. In the preferred embodiments, the sides of the torso portion can stretch by at least about four inches.

As mentioned above, one particular attribute of the present embodiments involves independent motion between the skirt portion and torso portion during various sporting activities. For instance in tennis the skirt portion would have a flow that is independent from the torso portion, which allows free leg movement without interfering with the skirt underneath. Moreover, sports such as tennis require extensive shoulder flexibility often requiring very short sleeves or sleeveless tops. When a conventional warm up jacket is worn during practice, the motion of raising the arm upward invariably causes the entire garment to "lift" up. This is perceived as a change in height from the bottom end of the jacket. Although this height can vary depending on the body dimensions of the athlete, it is often at least about 4-5 inches.

As such, another aspect of the present embodiments concerns a balance between the tight fit of the band portion and the elastic response of elastic element(s). It is desirable that the skirt portion and torso portion move sufficiently independent from one another such that when an individual wearing the apparel raises one or both arms the skirt portion does not move upward. One concern is that if the elastic elements do not elongate or stretch sufficiently during an athletic movement the band (and the skirt portion) could ride up. However, countering this problem with an even tighter band portion may leave the individual very uncomfortable, and potentially reduce blood circulation in the waist/hip region. Thus in one embodiment, the band portion is sufficiently snug to provide a stable fit around the waist (and/or hips) to keep the skirt portion from substantially rising up when the torso portion stretches to react to athletic movement. The band portion may comprise natural, synthetic or a combination of such material. In one embodiment, the band portion comprises a fabric comprising at least 10 percent spandex. In another embodiment, the band portion comprises a fabric comprising spandex and polyester. In some embodiments, the band portion is at least two inches in width, more preferably between about 2 inches and about 4 inches wide. In one embodiment, the band portion is adjustable in length and/or width to accommodate a person's preference or body type.

The apparel in the present embodiments may include additional features commonly found in outdoor sporting apparel. For instance, the fabric of the apparel may be ventilated or comprise a water resistant coating. Moreover, the torso portion may comprise a neck portion to keep a player's neck warm. Alternatively, the torso portion may comprise a hood to keep a player's head warm. Moreover, the apparel may include fastening features such as buttons or a zipper. In a particular embodiment, the body portion of the apparel comprises a neck portion and a zipper spanning the entire length of the body portion.

The present embodiments are further described in the accompanying figures, without any intent to limit the embodiments.

DETAILED DESCRIPTION OF THE FIGURES

In FIG. 1, the apparel 1 comprises two arm portions 3 connected to a body portion 2. The body portion comprises a torso portion 4 at the top, a skirt portion 5 at the bottom, and a band portion 6 located between the torso portion 4 and the skirt portion 5. The top of the torso portion 2 comprises a neck portion 9. Additionally, a zipper 10 spanning the entire length of the apparel 1 facilitates wearing and removing the apparel 1. In this particular apparel 1, the torso portion 4 comprises elastic elements 7 extending from the band portion 6 to the underarm region, which is in this case at about the armpit. Here, each elastic element 7 is located along the sides of the torso portion 4 next to an individual's ribs. An arm portion 3 extending fully upward produces the elongated portion of the elastic element 8. This elongation 8 combined with the compression from the band portion prevents the skirt portion 5 from moving upward.

Figure 2:
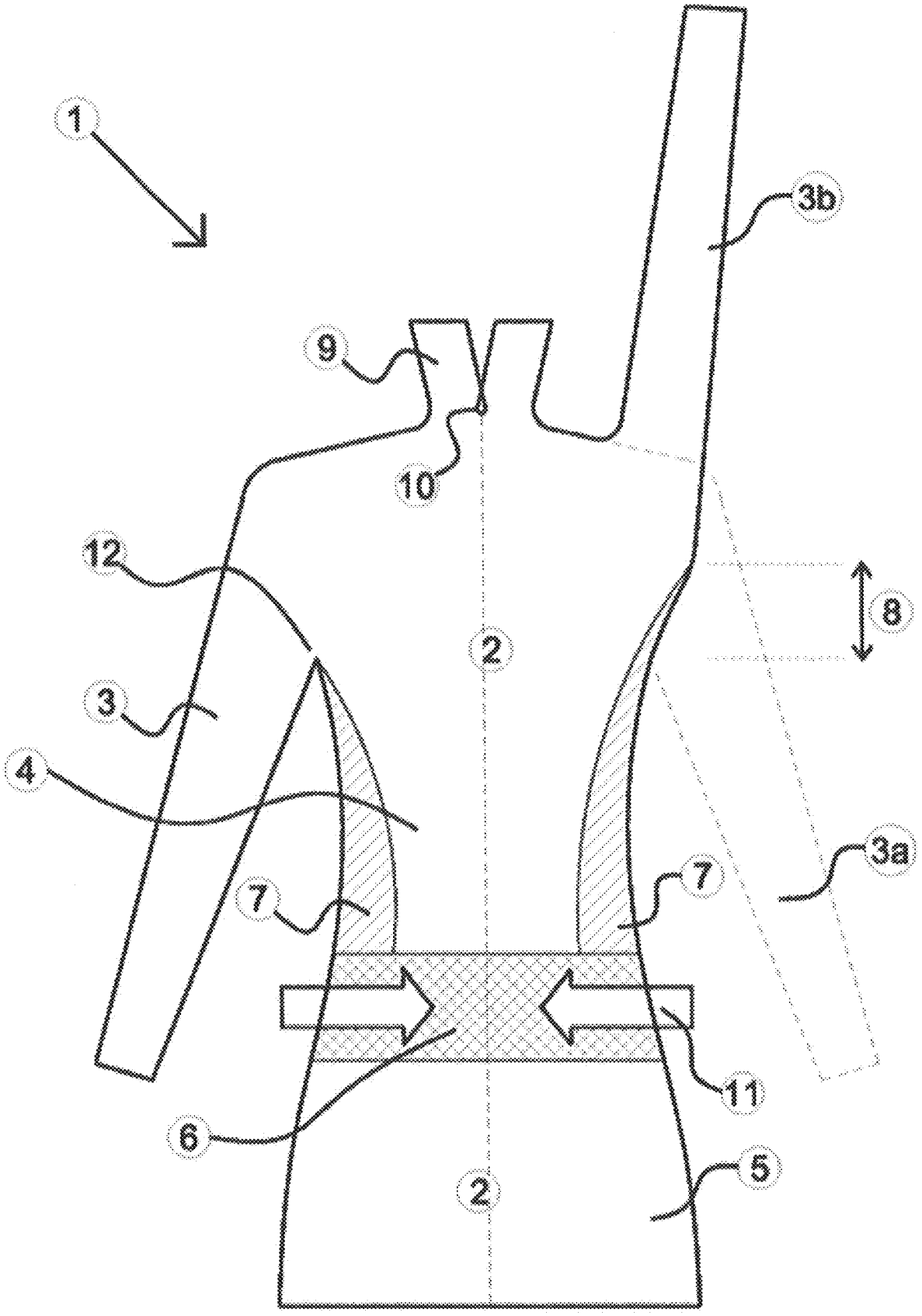
FIG. 2 depicts an apparel according to another embodiment

In the apparel shown in FIG. 2, the arm portion positions 3*a* (resting), and 3*b* (raised) are both shown. The elastic element 7 on the side where the arm portion 3*b* is in a raised position, resulting in the elongated portion 8. The elongated portion 8 of the elastic element combined with the compressive force 11 at the band portion 6 prevents the skirt portion 5 of the body portion 2 from rising up.

Figure 3A:
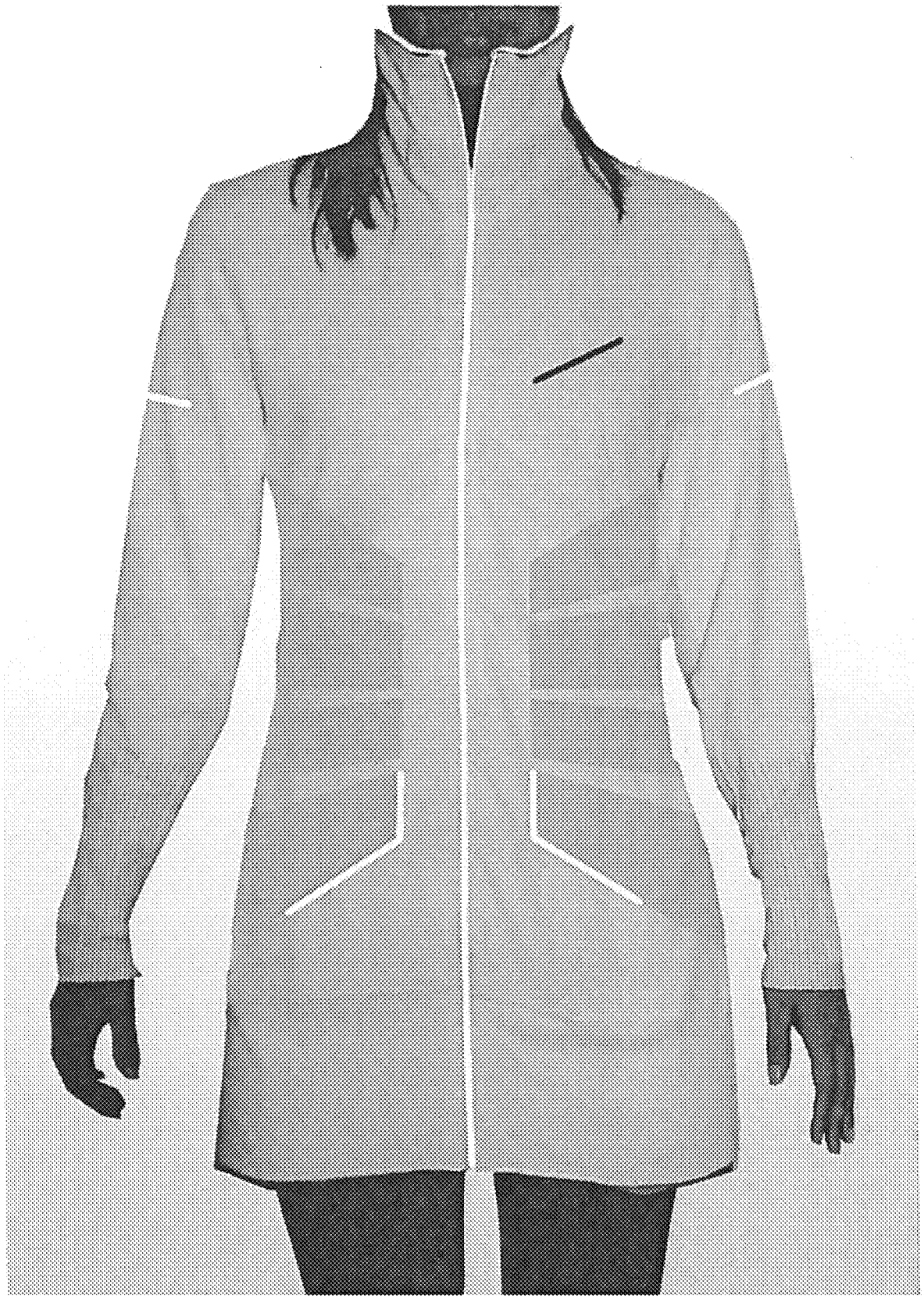
FIGS. 3*a*-3*c* depict the overall look of apparel according to several embodiments
Figure 3B:
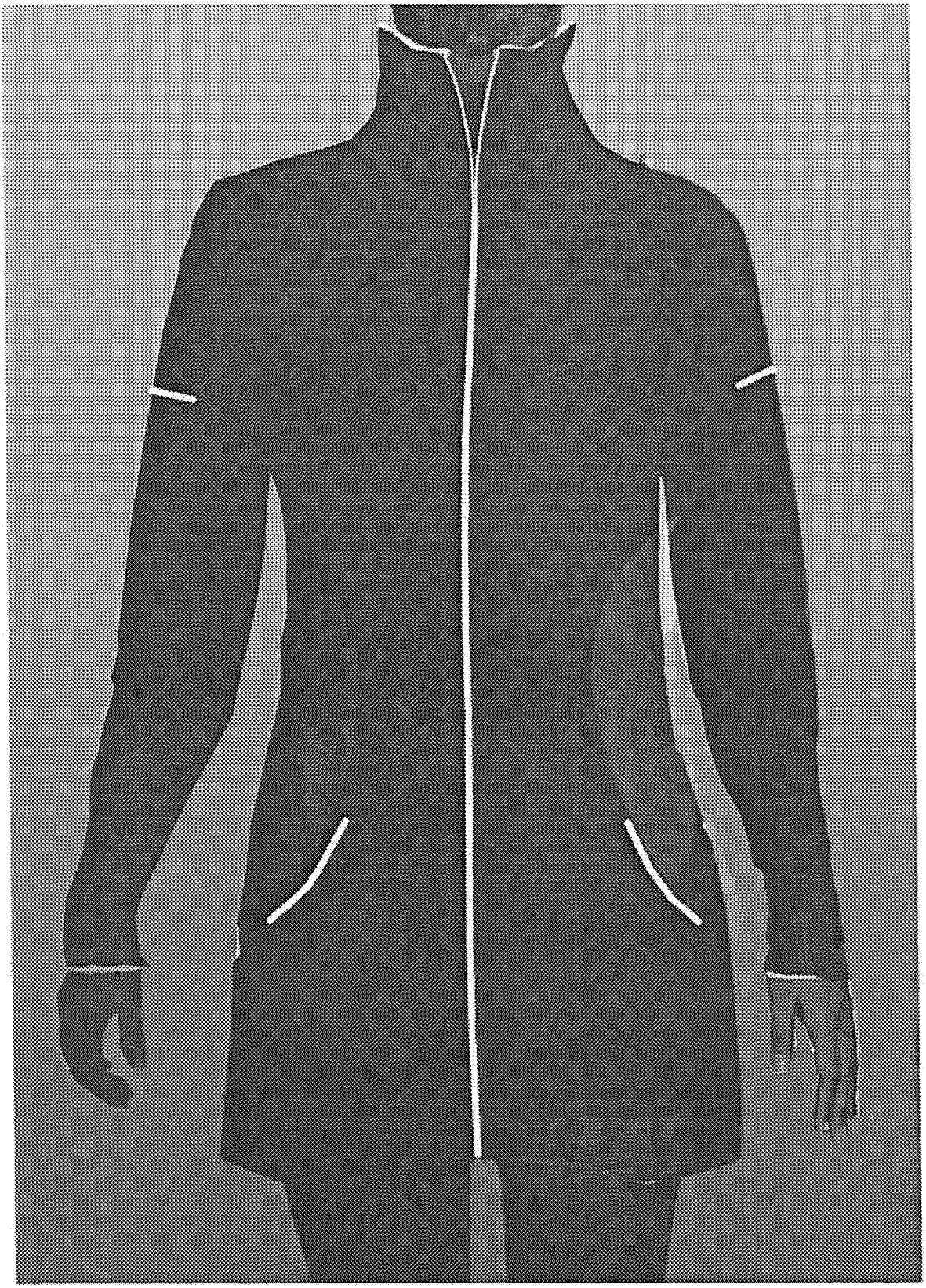
Figure 3C:
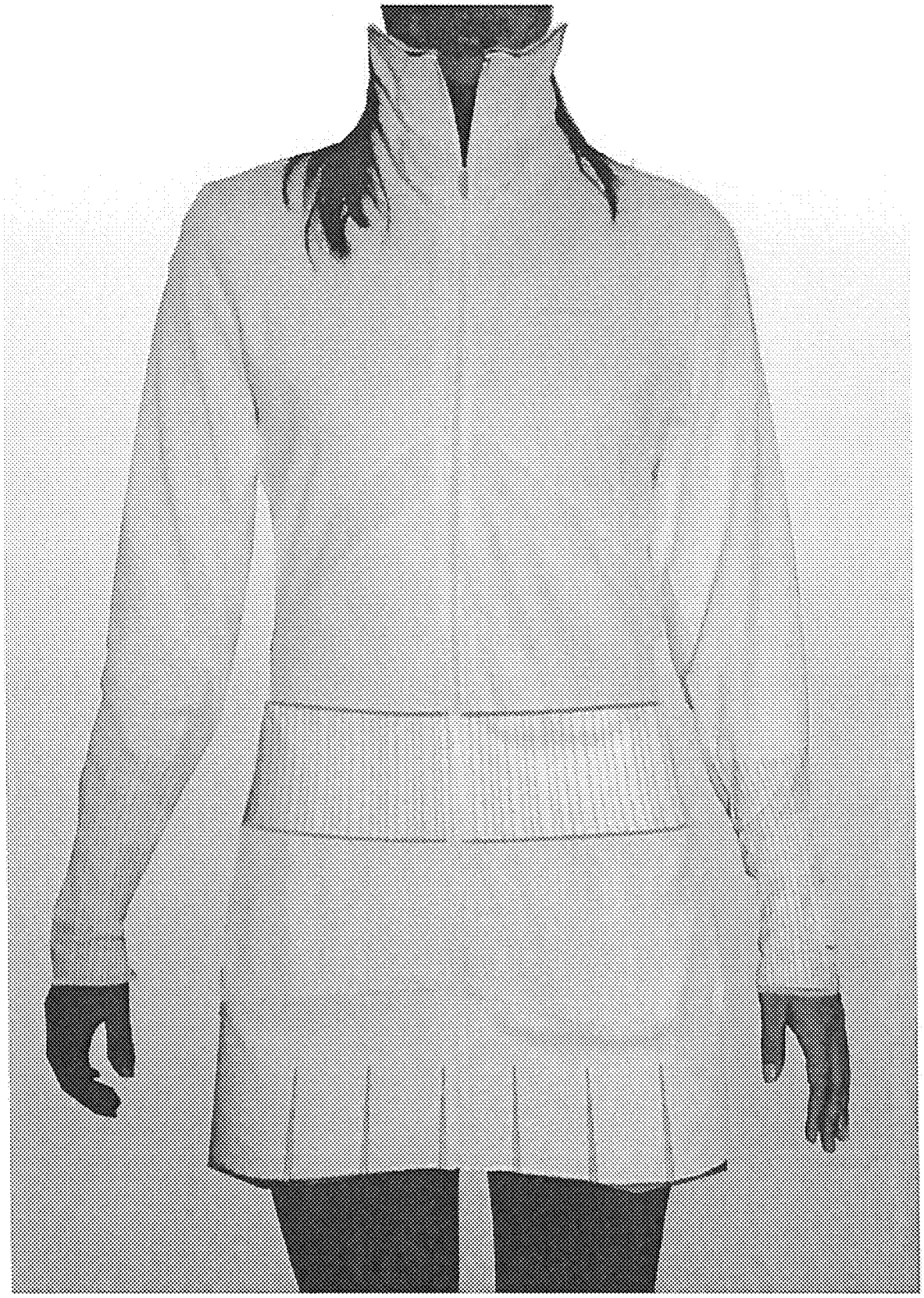
Figure 4A:
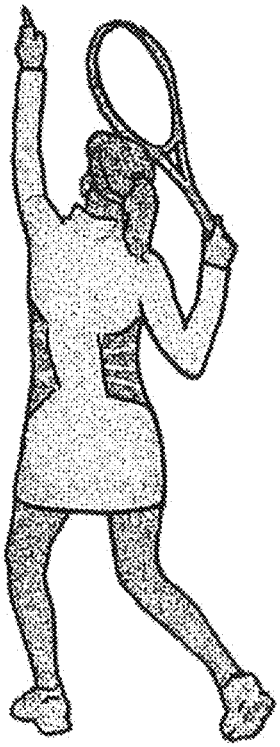
FIGS. 4*a*-4*d* depict several movements of a tennis athlete wearing an apparel according to an embodiment.
Figure 4B:
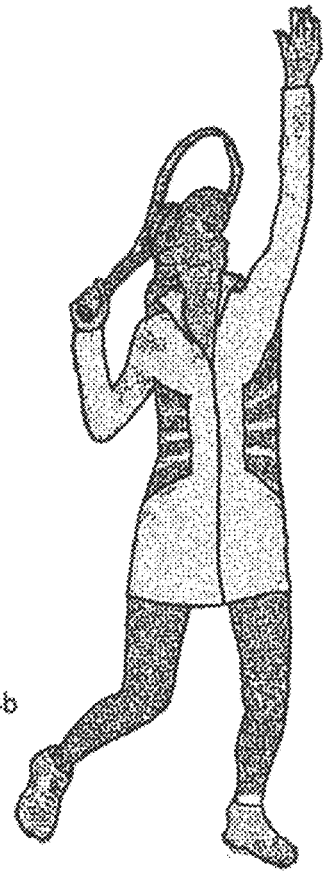
Figure 4C:
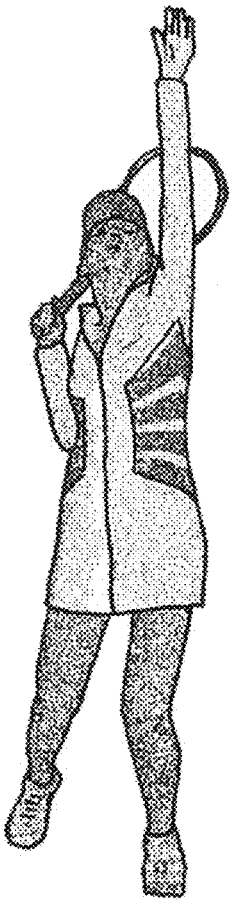
Figure 4D:
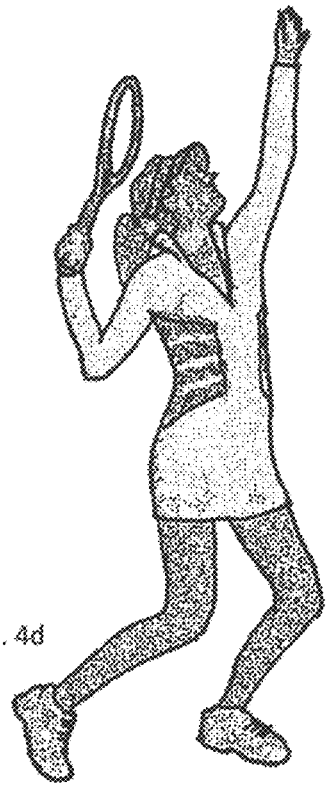
Figure 5A:
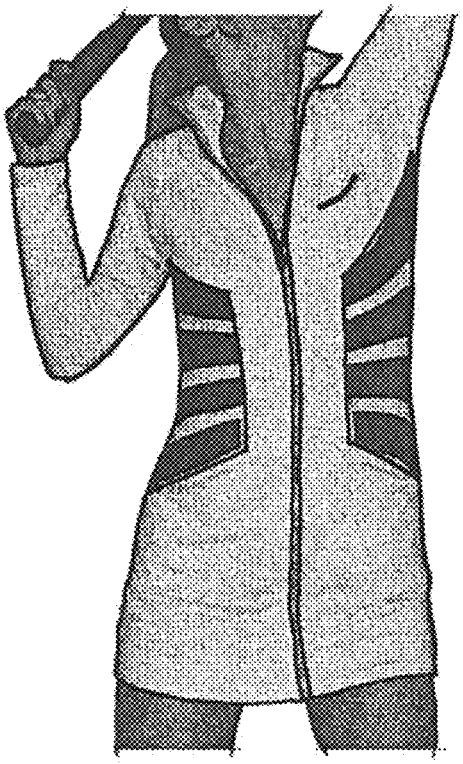
FIGS. 5*a*-5*d* also depict several movements of a tennis athlete wearing an apparel according to an embodiment.
Figure 5B:
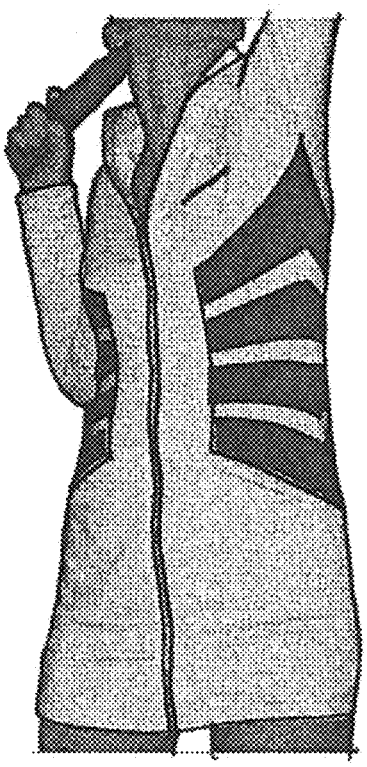
Figure 5C:
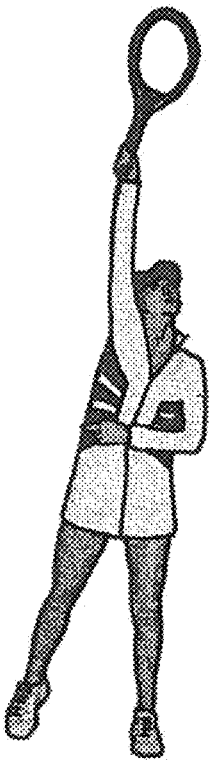
Figure 5D:
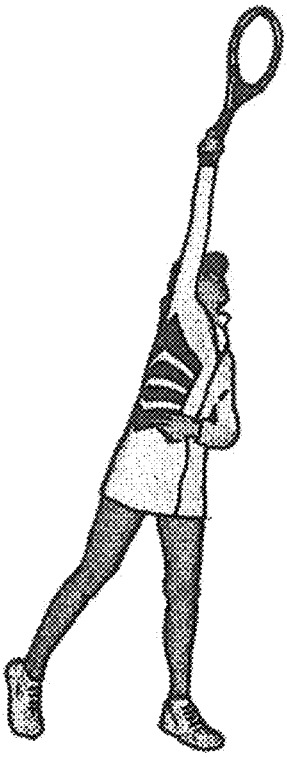
Figure 6A:
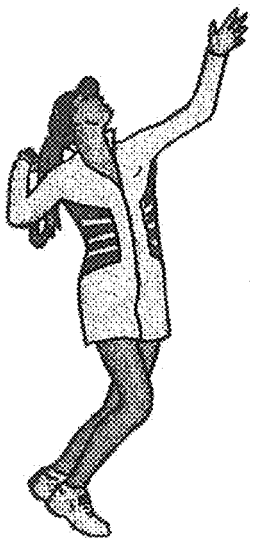
FIG. 6*a*-6*g* further depict several movements of a tennis athlete wearing an apparel according to an embodiment.
Figure 6B:
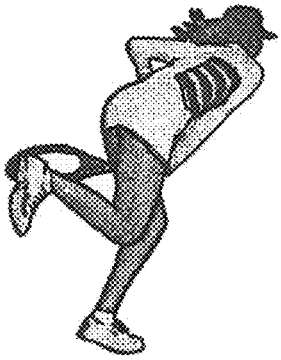
Figure 6C:
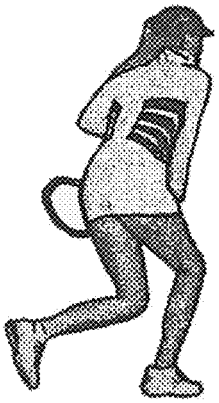
Figure 6D:
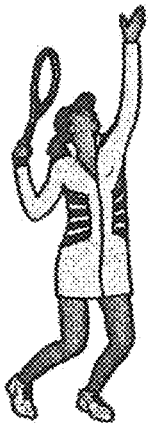
Figure 6E:
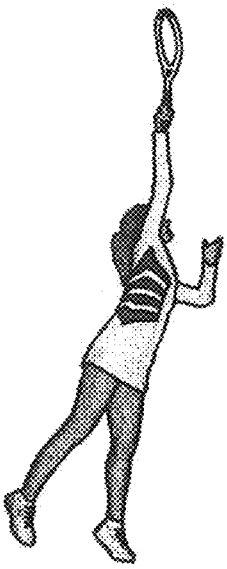
Figure 6F:
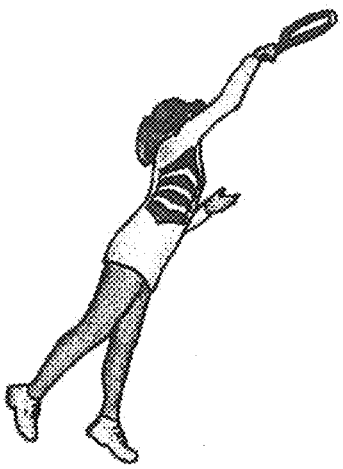
Figure 6G:
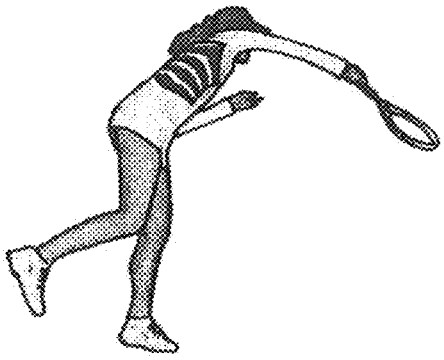
Figure 7A:
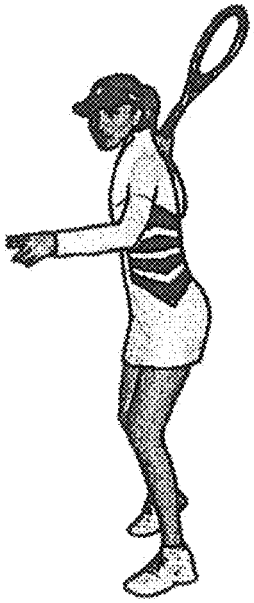
FIGS. 7*a*-7*g* depict yet additional movements of a tennis athlete wearing an apparel according to an embodiment
Figure 7B:
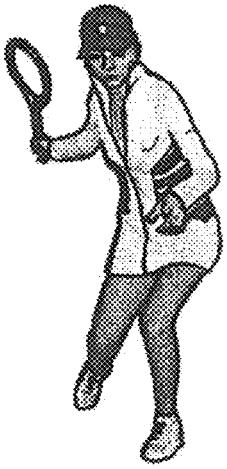
Figure 7C:
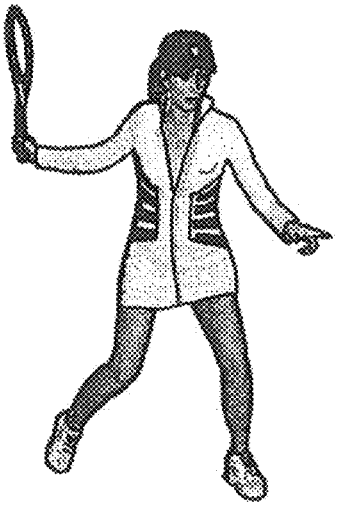
Figure 7D:
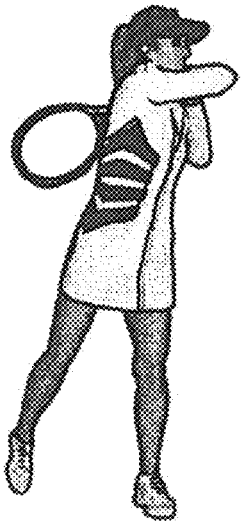
Figure 7E:
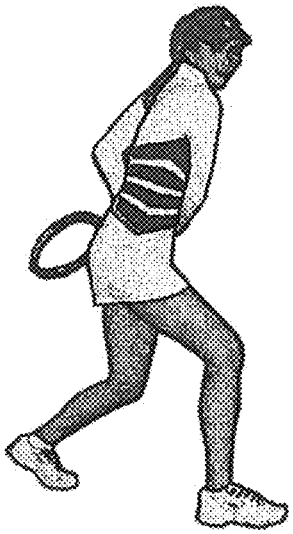
Figure 7F:
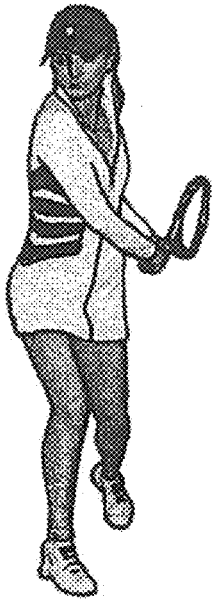
Figure 7G:
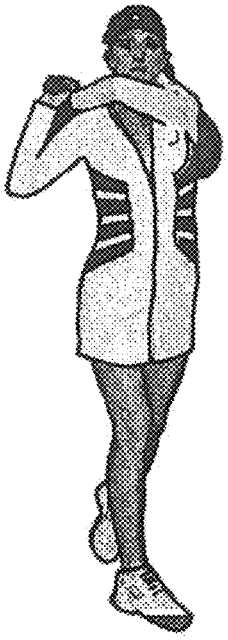
Figure 8:
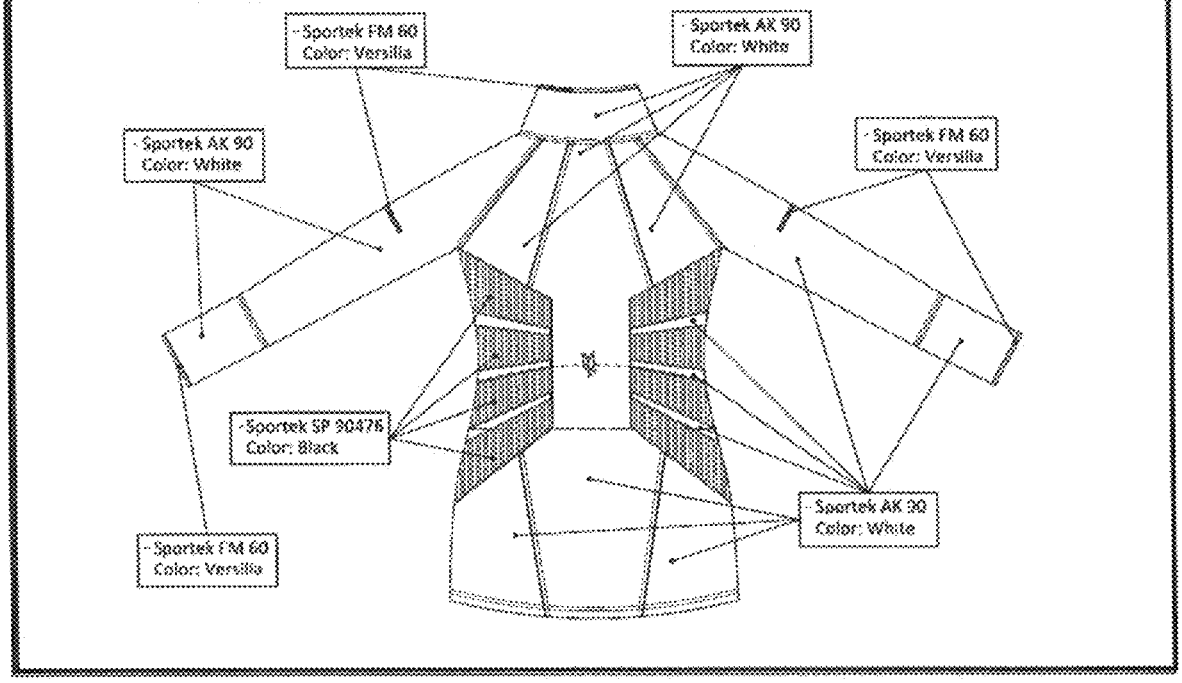
FIG. 8 depicts an apparel according to one embodiment along with specific details of construction and materials.
Figure 9:
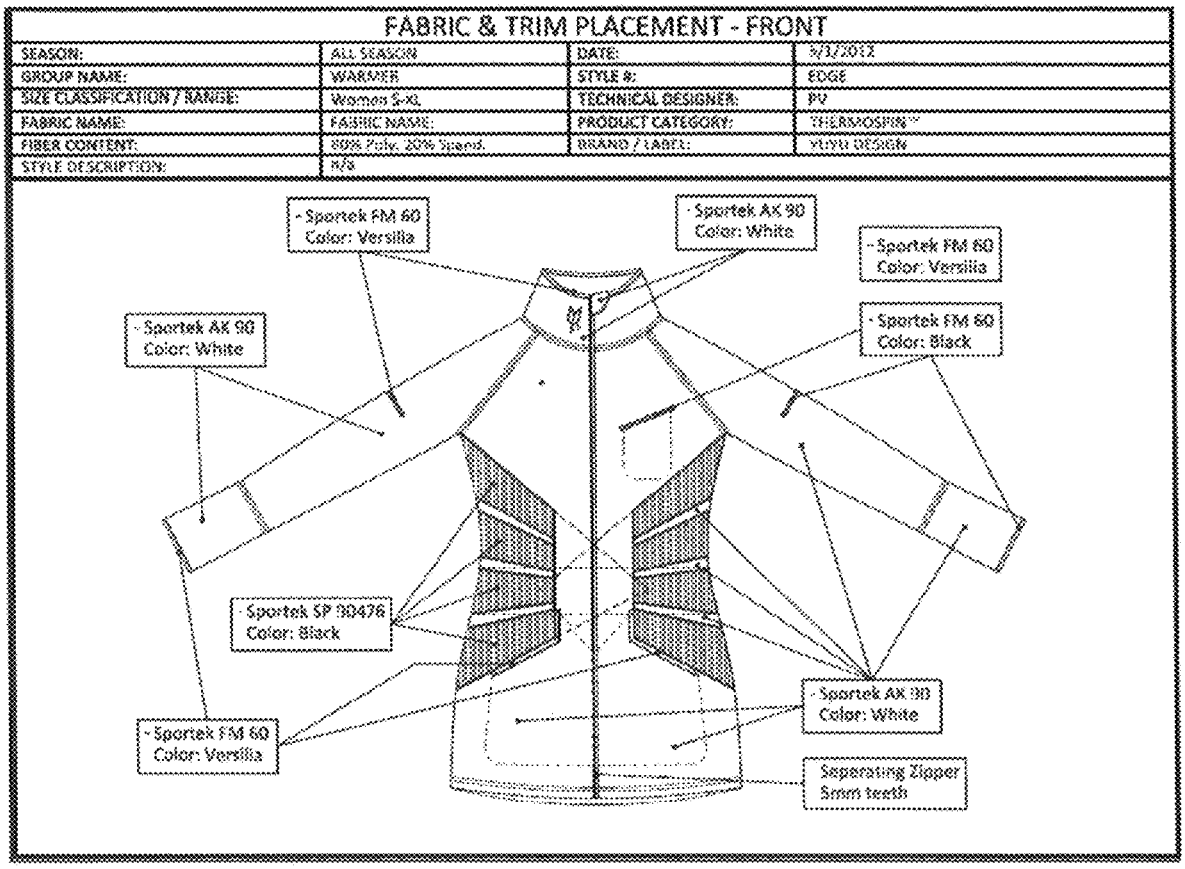
FIG. 9 depicts an apparel according to another embodiment along with specific details of construction and materials.
Figure 10:
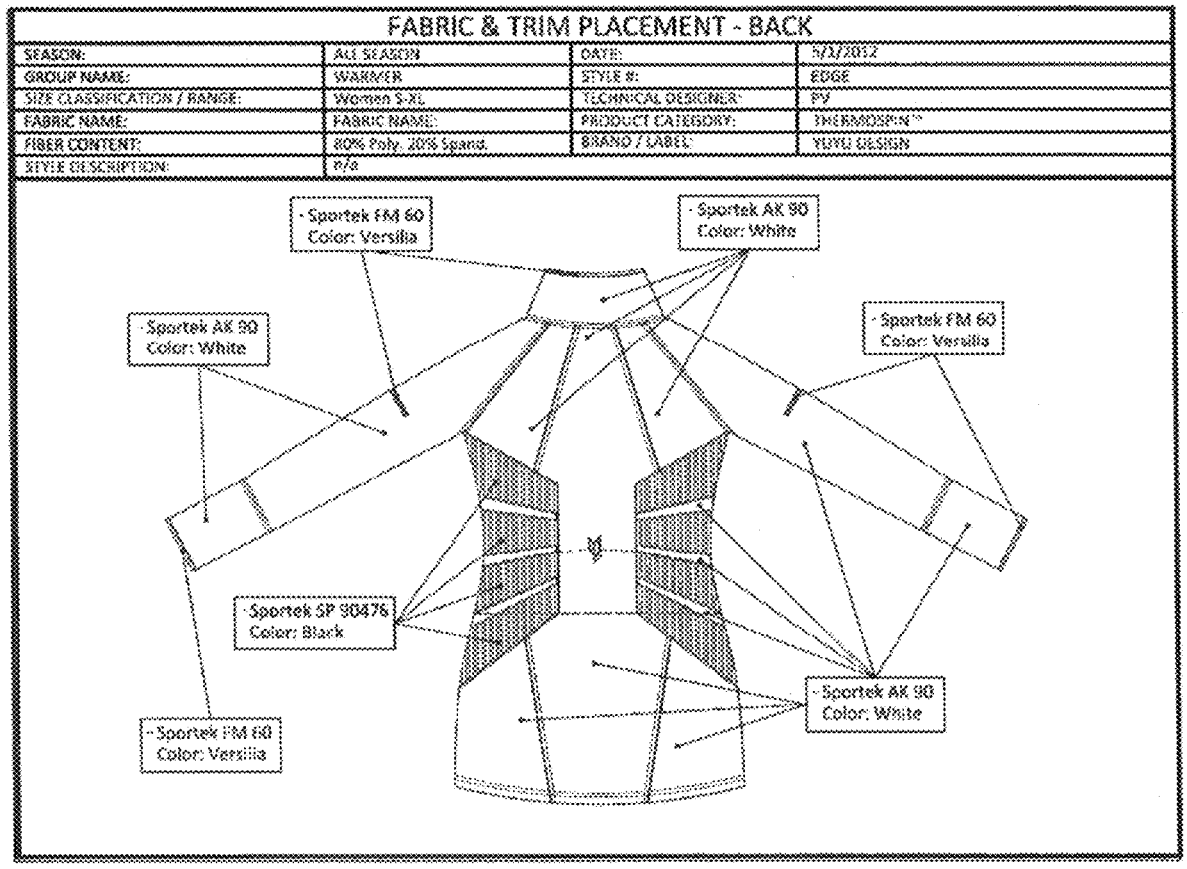
FIG. 10 depicts an apparel according to yet another embodiment along with specific details of construction and materials.
Figure 11:
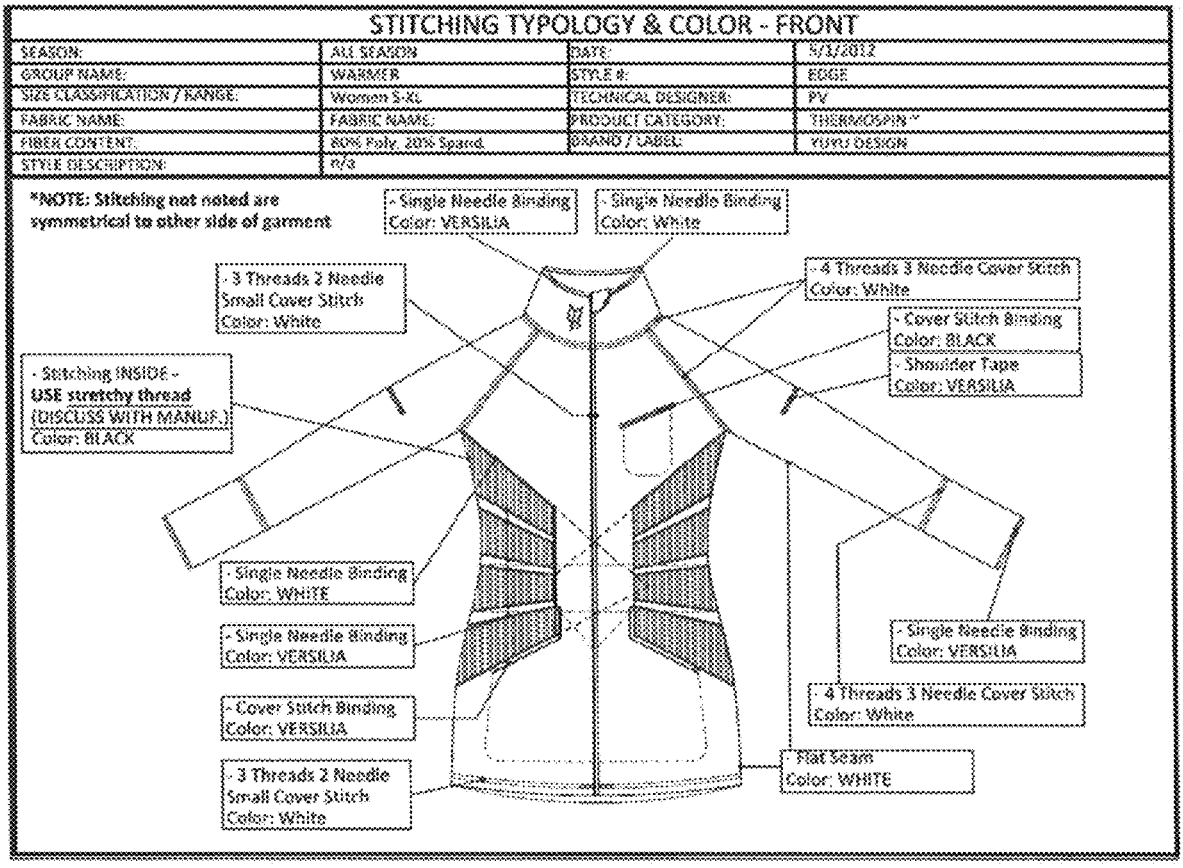
FIG. 11 depicts an apparel according to still another embodiment along with specific details of construction and materials.

FIGS. 3*a*-3*c* illustrate the overall shape of the apparel, according to several embodiments. As shown, the exterior of the apparel may take on various designs while retaining the functional features. For instance, in some embodiments the band portion may not be immediately apparent from exterior of the apparel.

FIGS. 4*a*-4*d* demonstrate, from several angles, a tennis athlete raising one arm to toss the ball during a serve. Here, the skirt portion remains substantially at the same location on the upper thigh on both sides even though one side of the apparel is being stretched due to the raised hand. FIGS. 5*a*-5*d* further illustrate that the bottom of the skirt portion remains substantially at the same location even when one arm is fully stretched upward, during the serve.

FIGS. 6*a*-6*g* present the full sequence of a tennis serve starting from the toss to the follow-through after service. As shown, during the sequence, the athlete's outstretched hand does not cause the bottom of the skirt portion to ride up. The bottom of the skirt portion remains substantially at the same location on the upper thigh area throughout the sequence. FIGS. 7*a*-7*g* illustrate the same aspect during a forehand and a backhand strike. The figures show that during both types of movement, the bottom of the skirt portion remains substantially at the same location on the upper thigh area.

Finally, FIGS. 8-11 present specific working examples of apparel according to various embodiments. These figures and accompanying tables provide specific details of fabric and construction of the apparel without limiting any of the present embodiments. Such working examples are provided in provisional patent application Ser. No. 61/634,424 to which the present application claims priority and hereby incorporates by reference within the present disclosure as if fully set forth.

In some embodiments, an apparel comprises a body portion, a pair of arm portions and an underarm region located between said body portion and each said arm portions. Specifically, the body portion, comprises a torso portion, a skirt portion, a band portion located between said torso portion and said skirt portion and at least one elastic element extending from the skirt portion to the underarm region. Further, the apparel comprises an interior area, where a band portion is located within said interior area of the apparel and underneath said at least one elastic element. In one embodiment, stretching an arm portion to a straight vertical position, along the length of said apparel, away from the skirt portion, results in the elastic element stretching a certain amount. The amount of stretch is preferably sufficient to substantially maintain the position of the skirt portion with respect to the individual's upper thighs. In a specific embodiment, the elastic element stretches by at least about two inches.

Figure 12:
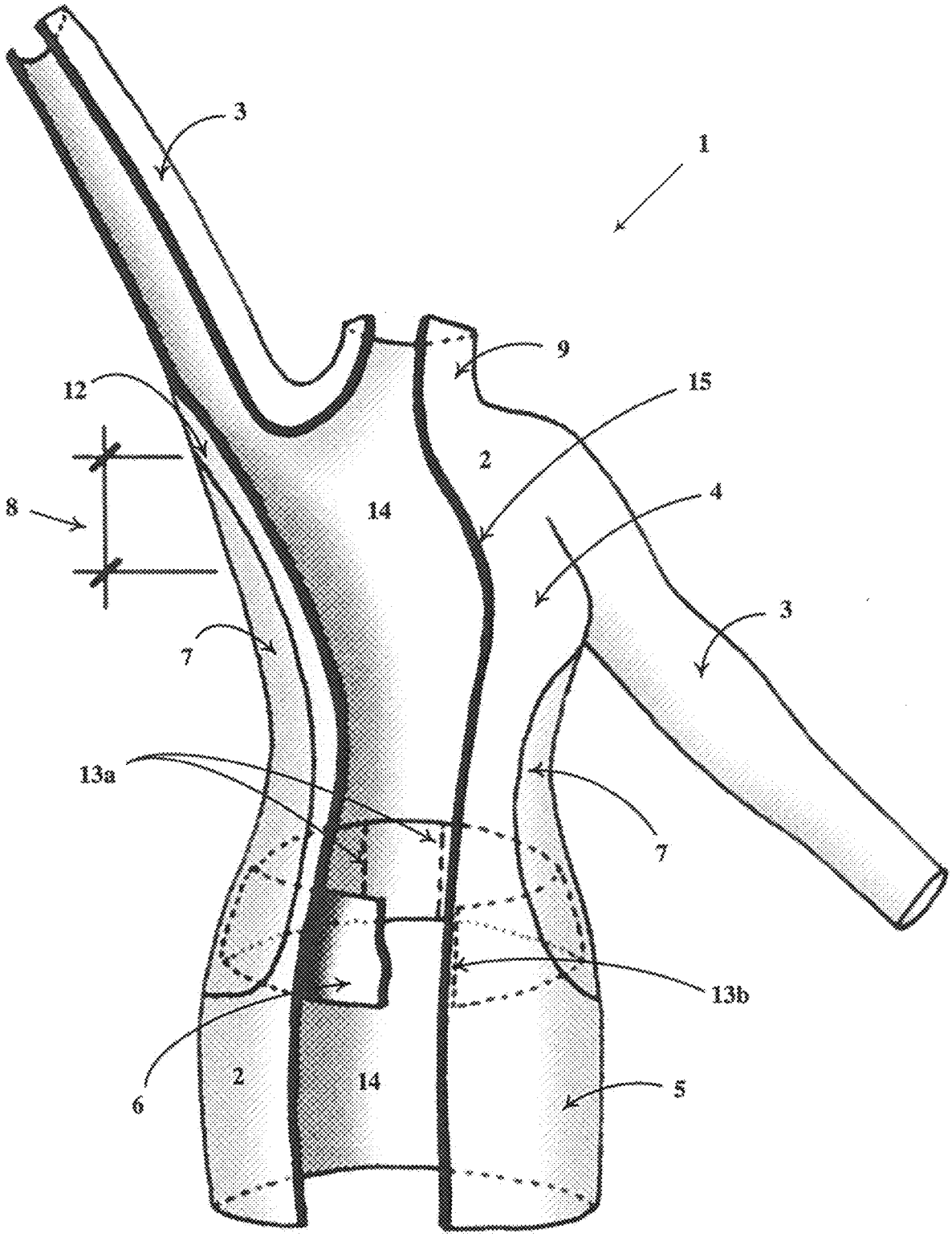
FIG. 12 provides a cutaway view an apparel according to one embodiment, showing the interior space of the apparel.
Figure 13:
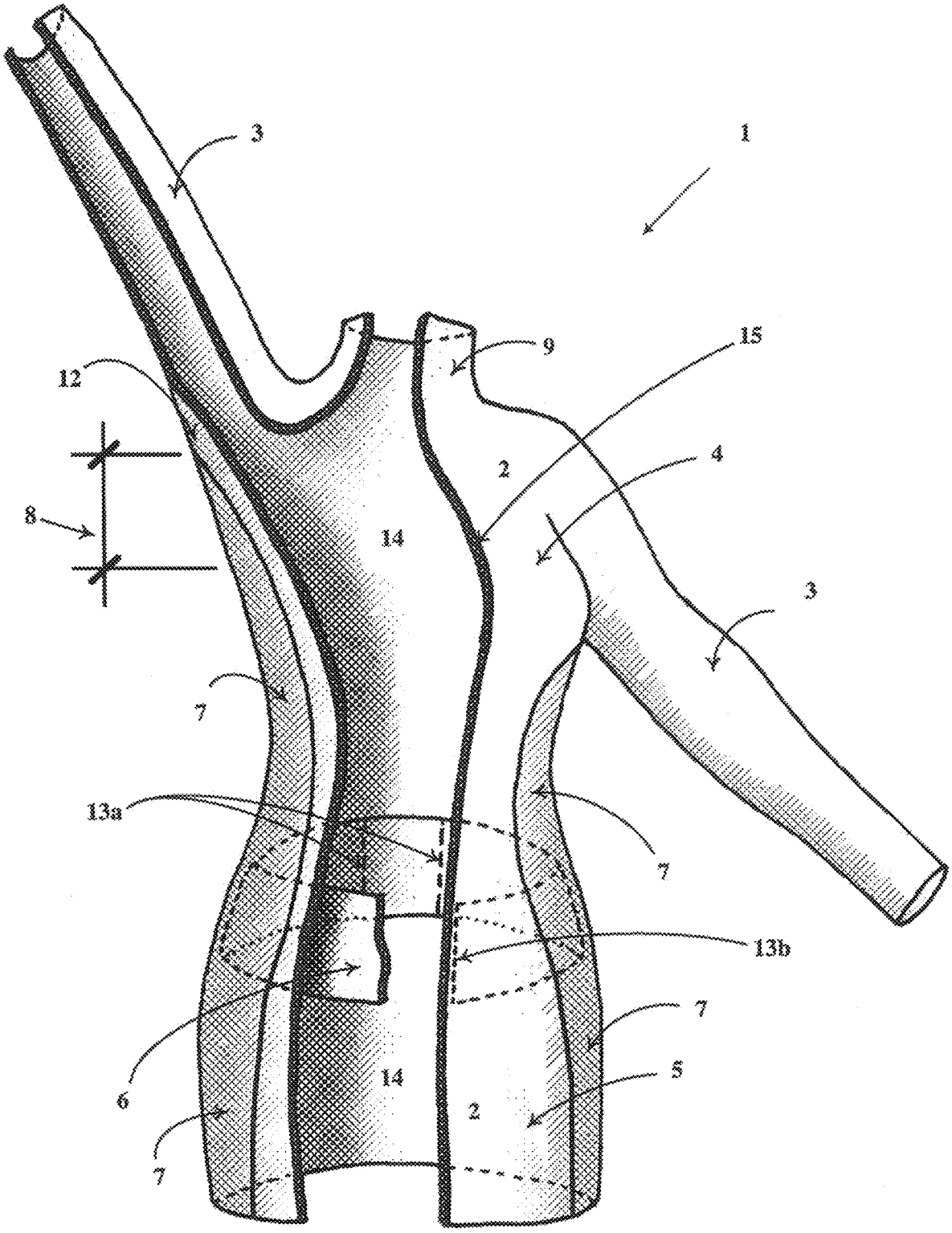
FIG. 13 provides a cutaway view an apparel according to another embodiment, also showing interior space of the apparel.

An apparel 1 according to some embodiments is shown in FIG. 12. Here, the apparel 1, comprises two arm portions 3 attached to a body portion 2. Specifically, the body portion 2 comprises a torso portion 4 at the top, a skirt portion 5 at the bottom and a band portion 6 located within the interior space 14 of the apparel 1, between the torso portion 4 and the skirt portion 5. The elastic elements 7 extend from the underarm region 12 to the skirt portion 5. Specifically here, the band portion 6 is located within the interior space 14 underneath the elastic elements 7 and therefore not directly connected to either elastic element 7. As shown, the band portion 6, is attached to the apparel 1, from the interior space 14 side at attachment location 13 *a* and 13 *b*. Although shown as two dashed lines, the attachment locations 13 *a* may be a single line of attachment, or a single point of attachment. Likewise, attachment locations in 13 *b*, which are located near the apparel edge 15 (next to the zipper teeth) may be points of attachment instead of lines. In this example, when one arm portion 3 is raised, the apparel 1 responds by elongating 8 the elastic element 7 on the side of the raised arm. At the same time, band portion 6, substantially maintains the position of the skirt portion 5 while one or both of the elastic elements 7 elongate. FIG. 13, is another apparel similar to FIG. 12, except that the elastic elements 7 extend from the underarm region to the end of the skirt portion 5. As shown in FIGS. 12 and 13, the apparel 1 has an interior surface located in the interior space 14. Also as shown, the band portion 6 is a separate piece from the body portion fabric, the band portion 6 is disposed on and attached to the interior surface of the apparel 1.

Figure 14:
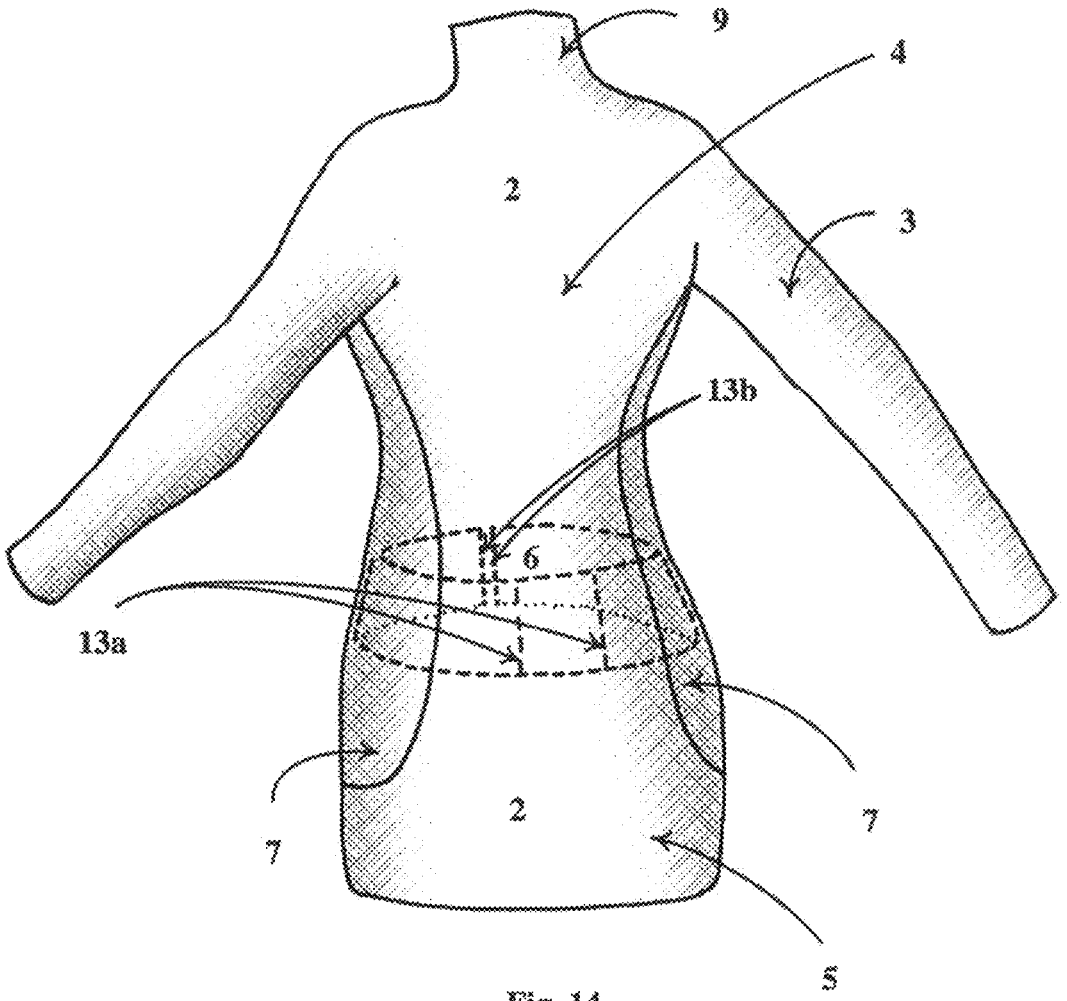
FIG. 14 is a rear view of an apparel according to an embodiment showing the elastic elements and the band portion.
Figure 15:
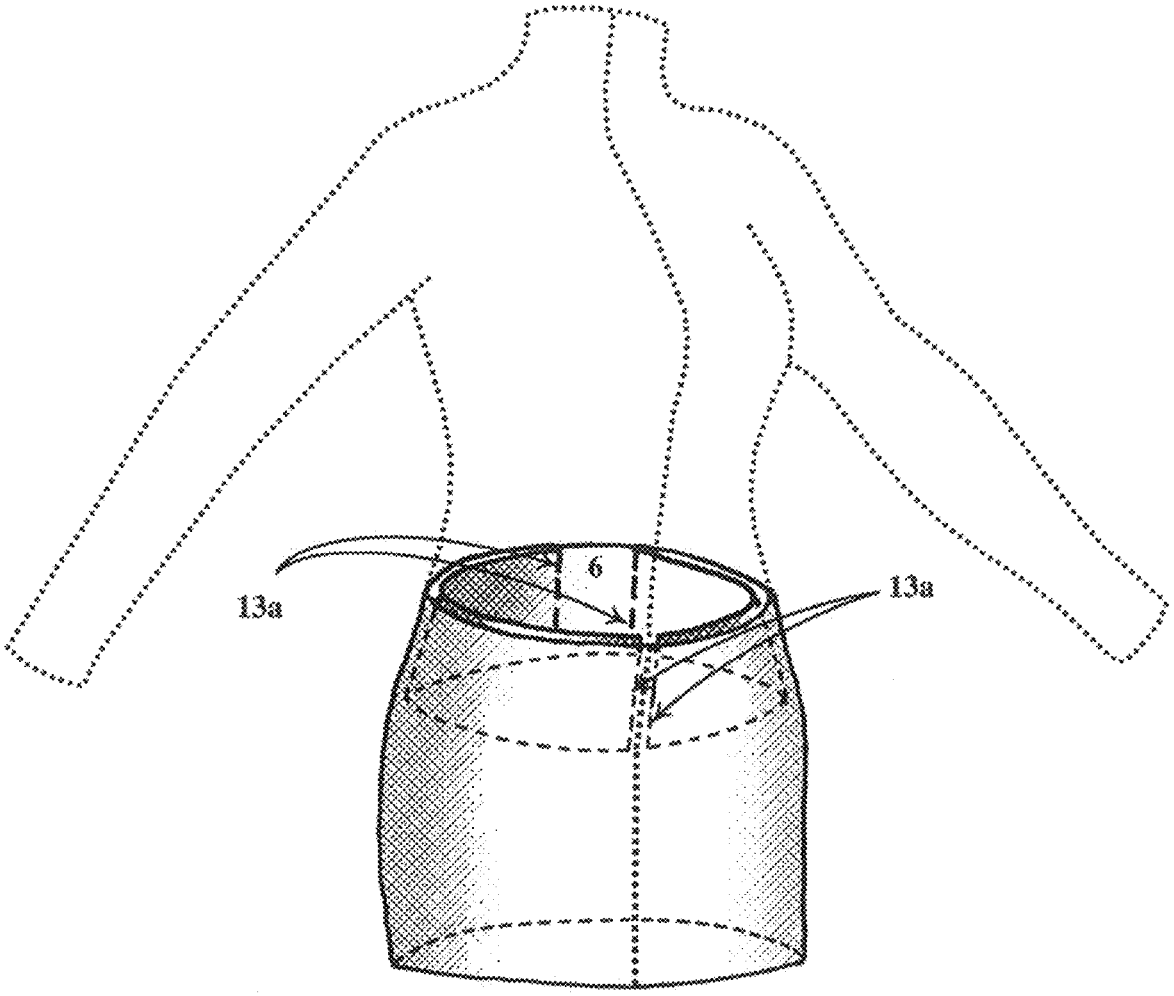
FIG. 15 is a sectional view of an apparel according to one embodiment showing the spatial relationship between the band portion and the body portion.

FIG. 14, shows an apparel 1 from the back specifically pointing out the attachment locations 13*a* and 13*b* of the band portion 6 from a different angle. Additionally, in FIG. 15 a portion of the apparel 1 is shown as transparent to demonstrate the spatial relationship between the garment body portion and the band 6 portion. Again here, the attachment locations 13*a* and 13*b* are shown.

Figure 16:
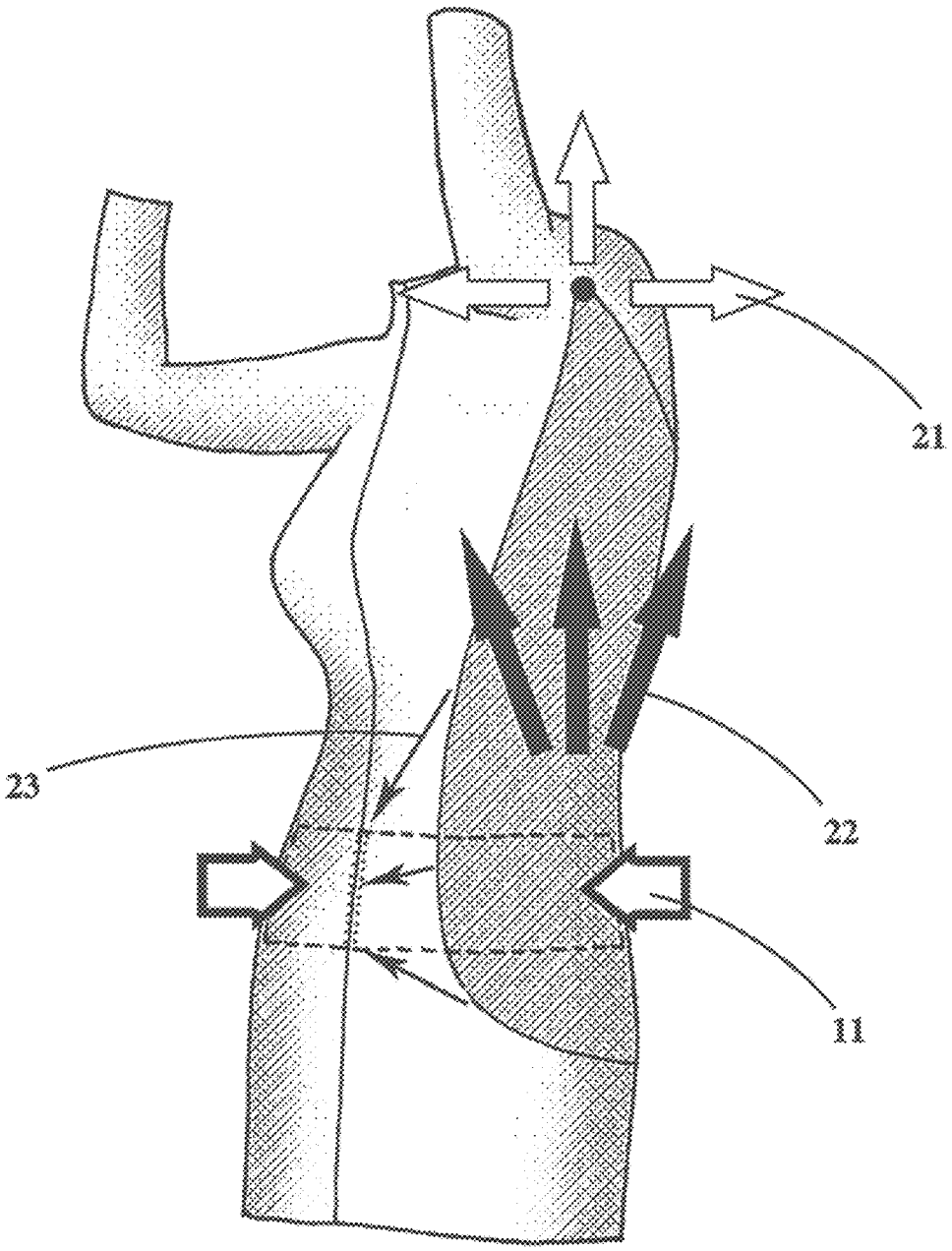
FIG. 16 is a front view showing various forces on an apparel when one arm is raised.
Figure 17:
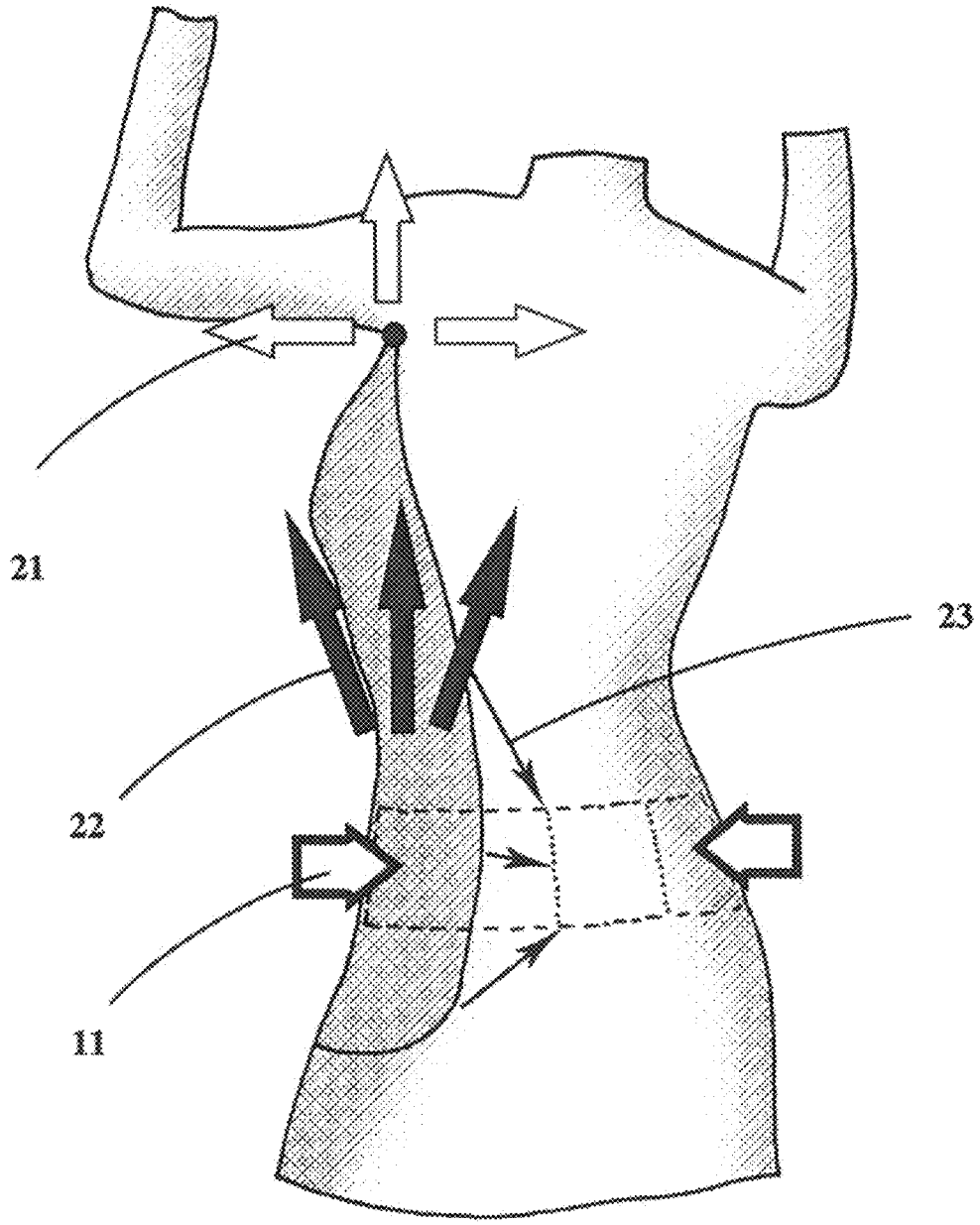
FIG. 17 is a rear view also showing various forces on a apparel when one arm is raised.

As discussed previously, activities such as raising one arm of the apparel results in at least one elastic element stretching. FIG. 16, is a simplified illustration of the forces present during such motion, from a front view of the apparel. The figure shows the underarm region forces 21, the elastic element(s) forces 22 as well as at the forces 23 at the attachment locations 13*a*. Also, the compressive force 11 on the band portion 6, which contributes to substantially maintaining the location of the skirt portion on the upper thigh is shown. Likewise, FIG. 17 also shows the forces acting on the apparel but from a rear view. Here, the underarm region forces 21, the elastic element(s) forces 22 as well as at the forces 23 at the attachment locations 13*b* are shown.

Based on the present disclosure a person of ordinary skill may construct the apparel described. As additional disclosure, in one embodiment, a method of constructing an apparel comprises the steps of:

(a) combining a first fabric piece with at least one elastic element to form a body portion, wherein said first fabric piece has different elasticity from said at least one elastic element, whereby the apparel comprises a body portion comprising a torso portion and a skirt portion, and a pair of arm portions such that an underarm region is located between said body portion and each said arm portions, and (b) attaching to the interior space of the apparel, between the skirt portion and the torso portion, a band portion, wherein the band portion is located under said at least one elastic element, and wherein said at least one elastic element extends from the torso portion to the skirt portion.

Figure 18:
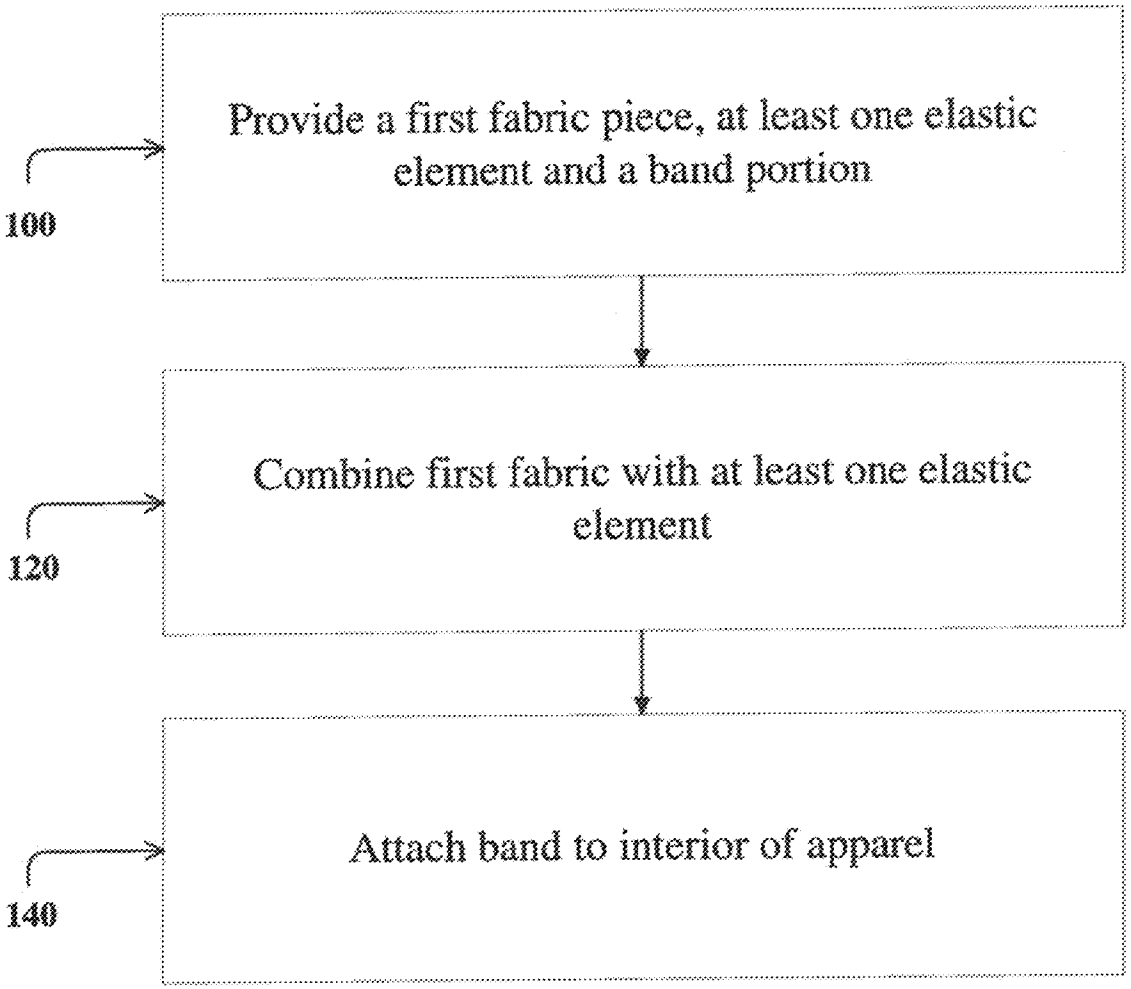
FIG. 18 is a flow diagram showing the steps of manufacture according to one embodiment.

Still, as a further example, FIG. 18 provides a method of constructing the apparel according to one embodiment. In this figure, the step 100 comprises providing a first fabric piece, at least one elastic element and a band portion. The fabric piece preferably comprises a body portion which comprises, a neck, torso and skirt portion. More preferably, the body portion comprises arm portions. In step 120 the elastic element is combined with the body portion such that it extends from the underarm region to the skirt portion. Finally, in step 140 the band portion is attached to the interior space of the apparel. A designer may reference the various apparel design and configurations shown in FIGS. 1-19, as well as the variations within the scope and spirit of the present embodiments to construct the apparel. Moreover, the designer may rely on knowledge and skill common in the art such as, but not limited to, sporting apparel, fashion apparel, or general clothing industry.

In the figures provided, particularly FIGS. 12-18, it should be understood that other arrangements of elastic element disclosed herein equally apply. For instance, a series of linearly spaced or connected elastic elements may be located between the underarm region and the skirt portion for any apparel shown. In some instances this arrangement of elastic elements may extend to, or all the way to the end of, the skirt portion.

While the foregoing written description of the present description enables one of ordinary skill to make and use what is considered presently to be the best mode thereof, those of ordinary skill will understand and appreciate the existence of variations, combinations, and equivalents of the specific embodiment, method, and examples herein. The embodiments should therefore not be limited by specific examples or figures, but by all embodiments and methods within the scope and spirit of the embodiments.

The invention claimed is:

1. An apparel comprising:

a body portion comprising a fabric, an interior area and an interior surface located in the interior area;

a pair of arm portions; and an underarm region located between said body portion and each of said arm portions; wherein the body portion further comprises: a torso portion; a skirt portion;

a band portion located between said torso portion and said skirt portion; and at least one elastic element extending from the skirt portion to the underarm region of each of said arm portions, wherein the band portion is a separate piece from the body portion fabric and is disposed on and attached to the interior surface of the body portion and, wherein the band portion is not directly connected to said at least one elastic element.

2. The apparel of claim 1, further comprising at least one elastic element extending from the band portion to the underarm region.

3. The apparel of claim 1, comprising two elastic elements, wherein said elastic elements are located on opposing sides of the torso portion.

4. The apparel of claim 3, wherein said two elastic elements each extend from the skirt portion to the underarm region.

5. The apparel of claim 1, wherein said at least one elastic element extends from the bottom of the skirt portion to the underarm region.

6. The apparel of claim 1, comprising one elastic element spanning the entire length of the apparel.

7. The apparel of claim 1, constructed such that stretching an arm portion to a vertical position, along the length of said apparel, away from the skirt portion, results in the elastic element stretching by at least about four inches.

8. The apparel of claim 1, constructed such that stretching an arm portion to a vertical position, along the length of said apparel, away from the skirt portion, results in the elastic element stretching by at least about one hundred percent.

9. The apparel of claim 1, constructed such that stretching an arm portion to a vertical position, along the length of said apparel, away from the skirt portion, results in the elastic element stretching by at least about two inches.

10. The apparel of claim 1, comprising integrated shorts located in the interior area of said apparel under the skirt portion.

11. The apparel of claim 1, comprising a zipper spanning the entire length of the body portion.

12. The apparel of claim 1, wherein said apparel is one piece.

13. The apparel of claim 1, wherein the band portion is attached to the rear of the apparel.

14. The apparel of claim 1, wherein the band portion is attached to the front of the apparel.

15. The apparel of claim 1, comprising a plurality of linearly connected elastic elements.

16. The apparel of claim 15, wherein said plurality of linearly connected elastic elements extend from the band portion to the underarm region.

17. The apparel of claim 16, wherein the plurality of linearly connected elastic elements can, in the aggregate, elongate by at least about four inches.

18. The apparel of claim 1, wherein the plurality of elastic elements comprise a ventilated fabric.

19. The apparel of claim 1, wherein the body portion fabric comprises natural and synthetic materials.

20. An apparel comprising: a body portion comprising a fabric; a pair of arm portions; and an underarm region located between said body portion and each of said arm portions; wherein the body portion further comprises: a torso portion; a skirt portion;

an elastic band portion located between the torso portion and the skirt portion; and at least one elastic element located between the elastic band portion to the underarm region of each of said arm portions, wherein said apparel comprises an interior area, and the elastic band portion is located within said interior area of the apparel and underneath said at least one elastic element, wherein the elastic band portion is not directly connected to said at least one elastic element, and wherein stretching an arm portion to a straight vertical position, along the length of said apparel, away from the skirt portion, results in the elastic element stretching by at least about two inches.

* * * * *